US010591242B2

(12) United States Patent
Balgaard

(10) Patent No.: US 10,591,242 B2
(45) Date of Patent: Mar. 17, 2020

(54) ADJUSTABLE ROTATING STOCK BUTT AND SIGHTING DEVICE

(71) Applicant: Stanley James Balgaard, Evansville, MN (US)

(72) Inventor: Stanley James Balgaard, Evansville, MN (US)

(73) Assignee: Stanley Balgaard, Evansville, MN (US)

( * ) Notice: Subject to any disclaimer, the term of this patent is extended or adjusted under 35 U.S.C. 154(b) by 0 days.

(21) Appl. No.: 15/731,720

(22) Filed: Jul. 24, 2017

(65) Prior Publication Data

US 2019/0025001 A1 Jan. 24, 2019

(51) Int. Cl.

| | |
|---|---|
| ***F41A 35/06*** | (2006.01) |
| ***F41G 11/00*** | (2006.01) |
| ***F41C 23/14*** | (2006.01) |
| *F41C 23/08* | (2006.01) |

(52) U.S. Cl.

CPC ..... *F41A 35/06* (2013.01); *F41C 23/14* (2013.01); *F41G 11/008* (2013.01); *F41C 23/08* (2013.01); *F41G 11/004* (2013.01)

(58) Field of Classification Search

CPC ..... F41C 23/04; F41C 23/14

USPC ..... 42/71.01, 72, 75.01, 75.04, 73, 148, 74, 42/139

See application file for complete search history.

(56) References Cited

U.S. PATENT DOCUMENTS

| | | | | | |
|---|---|---|---|---|---|
| 1,088,362 | A * | 2/1914 | Perkins | F41C 23/08 | 42/73 |
| 1,651,299 | A * | 11/1927 | Stansel | F41C 23/14 | 42/73 |
| 2,066,218 | A * | 12/1936 | Morgan | F41C 23/14 | 42/73 |
| 2,613,442 | A * | 10/1952 | Austin | F41G 1/473 | 42/139 |
| 2,787,855 | A * | 4/1957 | Guymon | F41C 23/14 | 42/73 |
| 3,434,213 | A * | 3/1969 | Lauder | F41G 1/473 | 42/139 |
| 5,009,021 | A * | 4/1991 | Nelson | F41C 23/14 | 42/73 |
| 5,367,812 | A * | 11/1994 | Lautrec | F41C 23/08 | 42/72 |
| 5,918,374 | A * | 7/1999 | Campbell | F41G 1/16 | 42/124 |
| 5,970,642 | A * | 10/1999 | Martin | F41C 23/14 | 42/73 |
| 7,386,952 | B1 * | 6/2008 | Henretty | F41C 23/04 | 42/71.01 |
| 8,720,099 | B1 * | 5/2014 | Sisk | F41C 23/14 | 42/73 |

(Continued)

*Primary Examiner* — John Cooper

(57) ABSTRACT

A novel and improved rotating stock butt and rotating sighting device that applies to a shoulder-fired firearm where the firing mechanism and the sighting device are elevated above the stock butt when in a horizontal shooting position. This system comprises a cooperation between the rotating stock butt and the rotating sighting device that allows the firing mechanism and the barrel to be off set to either the right or to the left of the stock butt while the rotating sighting device and sight bead remains on the top center of the firearm. This allows the shooter to mount the gun with very little head movement.

10 Claims, 12 Drawing Sheets

(56) References Cited

U.S. PATENT DOCUMENTS

| | | | | |
|---|---|---|---|---|
| 2003/0079394 | A1* | 5/2003 | Poff, Jr. | F41C 23/06<br>42/74 |
| 2003/0221352 | A1* | 12/2003 | Steele | F41C 23/14<br>42/73 |
| 2005/0241205 | A1* | 11/2005 | Rotundo | F41C 23/14<br>42/71.01 |
| 2005/0268516 | A1* | 12/2005 | Nelson | F41C 23/16<br>42/73 |
| 2007/0214697 | A1* | 9/2007 | Ochoa | F41C 23/14<br>42/73 |
| 2008/0028662 | A1* | 2/2008 | Abraham | F41C 23/14<br>42/73 |
| 2013/0036650 | A1* | 2/2013 | Larue | F41G 11/003<br>42/148 |
| 2013/0174465 | A1* | 7/2013 | Martinez Martinez | F41G 1/473<br>42/139 |
| 2014/0109453 | A1* | 4/2014 | Paquette | F41C 23/14<br>42/73 |
| 2016/0123697 | A1* | 5/2016 | Balgaard | F41C 23/08<br>42/74 |

* cited by examiner

ADJUSTABLE ROTATING STOCK BUTT AND SIGHTING DEVICE

BACKGROUND OF INVENTION

A. Field of Invention

The invention pertains to shoulder-fired firearms in general and introduces a new and improved way of rotating the stock butt and the sighting device to obtain a better fit in the gun mount.

B. Description of Related Art

There has not previously been a rotation of a stock butt and a sighting device which allows for an offset of the firing mechanism and the barrel to either the left or to the right of the stock butt permitting the shooter to align the eye with a sighting device without rotating the head.

BRIEF SUMMARY OF THE INVENTION

A rotating stock butt system, comprising an internal aligning tube which becomes the access point the stock butt rotates about; a narrowing of the cheek weld between the grip and the shoulder recoil pad configured in a fin like design; a series of spacers which shorten or lengthen the stock butt and also provide a locking means that when tightened secures the stock butt in a selected position, which prohibits the stock butt from rotating; a series of rotating sights that rotate around the firearm barrel; a rotating stock butt and rotating sight device, when secured, are configured to cooperate together to assure the sight always remains top center of the firearm barrel giving equal advantage to both right and left handed shooters, allowing minimal head movement in the gun mount to align the gun with the sight.

BRIEF DESCRIPTION OF DRAWING

All drawings are depicted with the shoulder-fired firearm in a horizontal firing position.

DETAILED DESCRIPTION OF DRAWING

Figure 1:
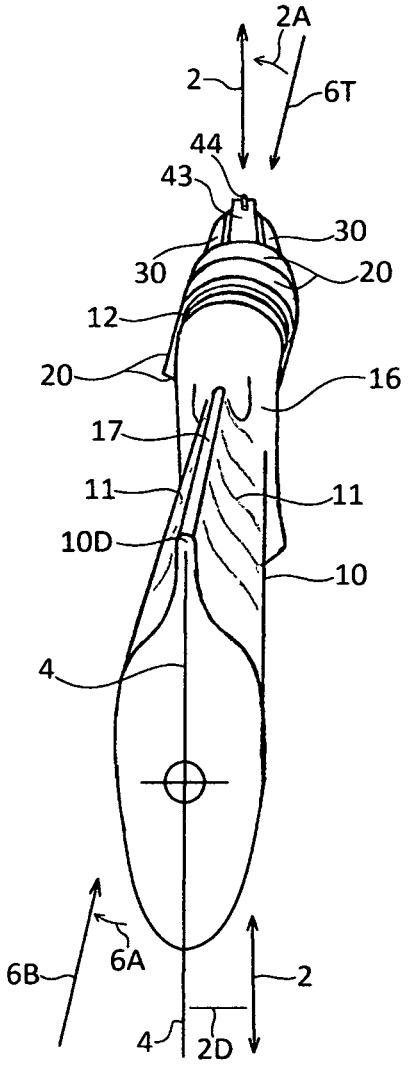
FIG. 1. Rear view of a shoulder-fired firearm, showing the offset of the stock butt of the firing mechanism and the top centering of the sighting device.

FIG. 1. Rotating stock butt (10) is in a vertical position indicated by center line (4).

Top side of firing mechanism (20) has been rotated to the right.

Bottom side of firing mechanism (20) has been rotated to the left.

Arrows (6T) and (6B) indicate the angle of rotation of firing mechanism (20).

Ventilated sighting rib (43) has been rotated to the top of barrel (30) indicated by double-headed arrows (2).

Arrow (2A) indicates the direction of rotation of the ventilated sighting rib (43) placing sight bead (44) at top center of barrel (30).

Pivot point (12) is the point of rotation between the first member (10F) and the second member (10S) of the rotating stock butt (10) that allows the firing mechanism (20) to be rotated to the right or to the left of center (4).

The top portion of rotating stock butt (10) is narrowed (17) from the rearward trailing end (10D) to the grip (16).

An inward concave depression (11) on both sides of the rotating stock butt (10) runs from the rearward trailing end (10D) of the rotating stock butt (10) to the grip (16).

Line (2D) indicates rotation to offset the rotating stock butt (10) from center of barrel (30) and ventilated sighting rib (43), indicated by double-headed arrows (2) and center line (4).

Figure 2:
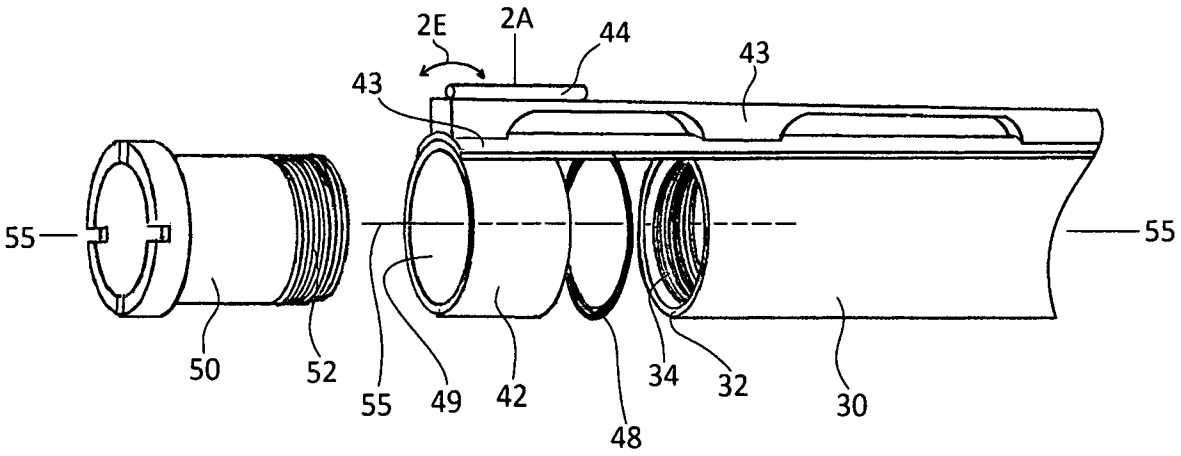
FIG. 2. Forward leading end of the barrel and the ventilated sighting rib.

FIG. 2. Rotating tube (42) links to ventilated sight rib (43).

Choke tube (50) has a rearward threaded end (52) that passes through openings (49) in rotating tube (42) and through locking ring (48) where it threads into threaded opening (34) in the forward leading end (32) of barrel (30).

Pathway of choke tube (50) is indicated by line (55).

When tightening choke tube (50), locking ring (48) holds rotating tube (42) and ventilated sighting rib (43) in selected position until choke tube (50) is adequately tightened.

Double-headed arrow (2E) indicates the rotation of the rotating tube (42) and the ventilated sight rib (43).

Figure 3:
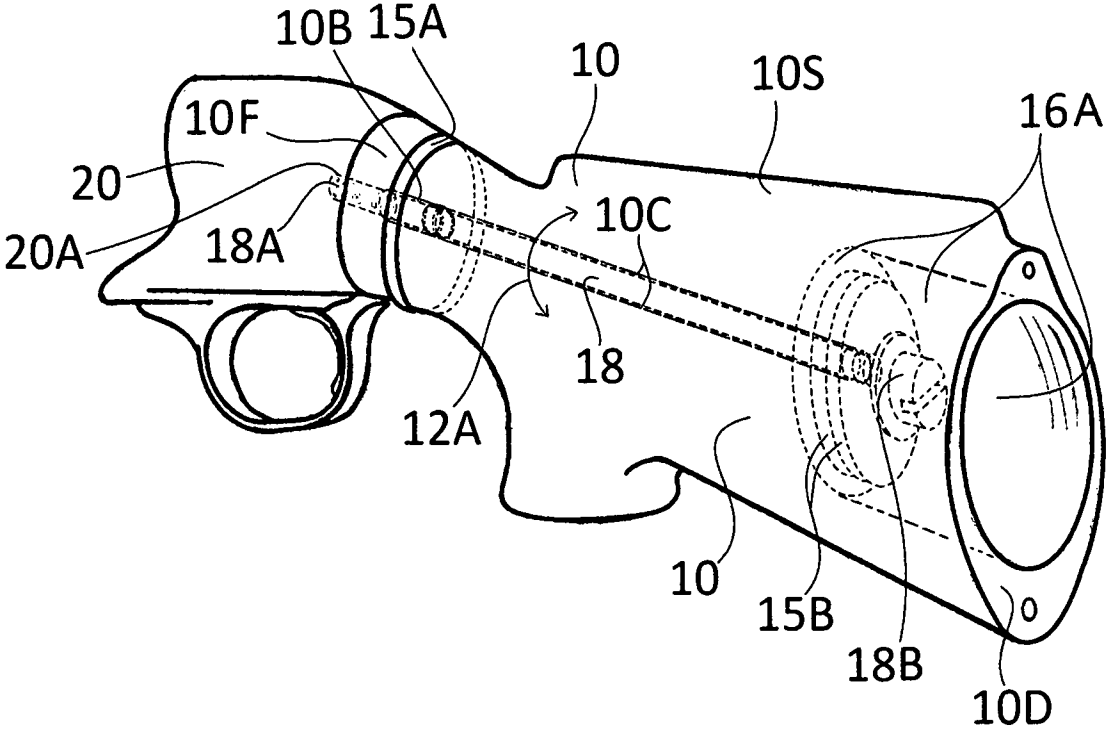
FIG. 3. Rear quartering side view of the rotating stock butt and firing mechanism.

FIG. 3. The first member of the rotating stock butt (10F) has a central opening (10B). The second member of the rotating stock butt (10S) has a central opening (10C) which allows an elongated fastener (18) to pass through.

The forward leading end of the elongated fastener (18) is threaded (18A), and threads into a threaded opening (20A) in the rearward trailing end of firing mechanism (20).

The second end of the elongated fastener has a tightening means (18B).

When elongated fastener (18) is tightened, it secures the first and second members of the rotating stock butt (10) in a selected position.

When the elongated fastener (18) is loosened, the second member (10S) of the rotating stock butt (10) is capable of rotating around the elongated fastener (18), indicated by double-headed arrow (12A).

Removable spacers (15) can be placed between the first member (10F) of the rotating stock butt (10) and the second member (10S) of the stock butt (10) and function to lengthen the rotating stock butt (10) by the number of removable spacers (15) used.

When removable spacers (15) are in storage, they are held in place by the elongated fastener (18) and the tightening means of the second end (18B) of the elongated fastener (18) in an opening (16A), in the rearward trailing end (10D) of the second member (10S) of the rotating stock butt (10). This assures that the threaded end of the elongated fastener (18A) threads to the same depth into the threaded opening (20A) in the firing mechanism (20).

Figure 4:
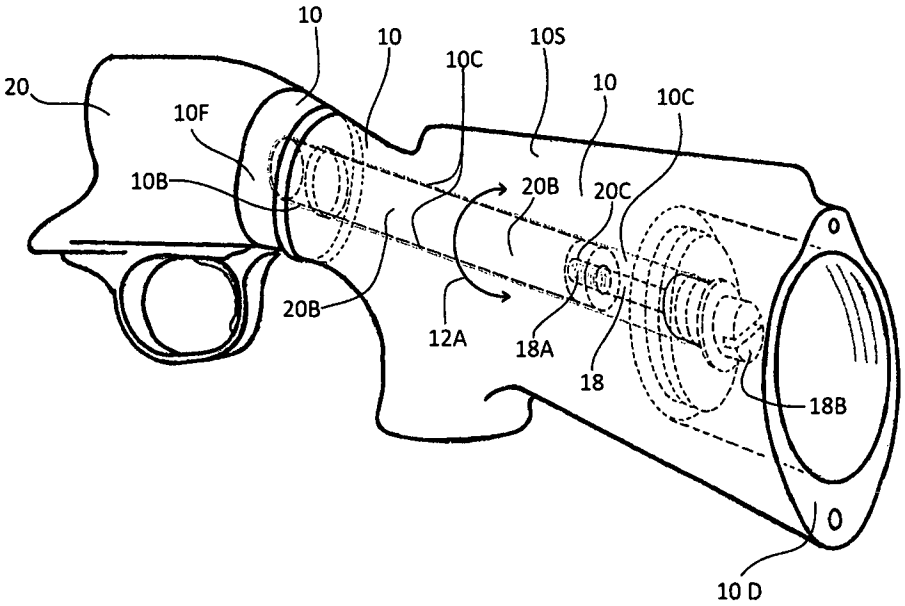
FIG. 4. Rear quartering side view of the rotating stock butt and firing mechanism showing the internal parts of an action spring tube.

FIG. 4. The action spring tube (20B) comprises the rearward trailing end of the firing mechanism (20) and is housed within opening (10B & 10C) of the first member (10F) and the second member (10S) of the rotating stock butt (10).

The elongated fastener (18) is also housed towards the rearward trailing end of the central opening (10C) in the second member (10S) of the rotating stock butt (10).

The forward leading end (18A) of the elongated fastener (18) is threaded, and threads into a threaded opening (20C) in the rearward trailing end of the action spring tube (20B).

The second end (18B) of the elongated fastener (18), has a tightening and loosening means.

When the elongated fastener (18) is loosened, the rotating stock butt (10) can be rotated in either direction around the action spring tube (20B) and elongated fastener (18) indicated by double-headed arrow (12A). When the elongated fastener (18) is tightened, it holds the second member (10S) and first member (10F) of the rotating stock butt (10) in a secure selected position.

The rearward trailing end (10D) of the stock butt (10) is configured to receive a recoil pad. Recoil pad not shown in FIG. 9 or 10.

Figure 5:
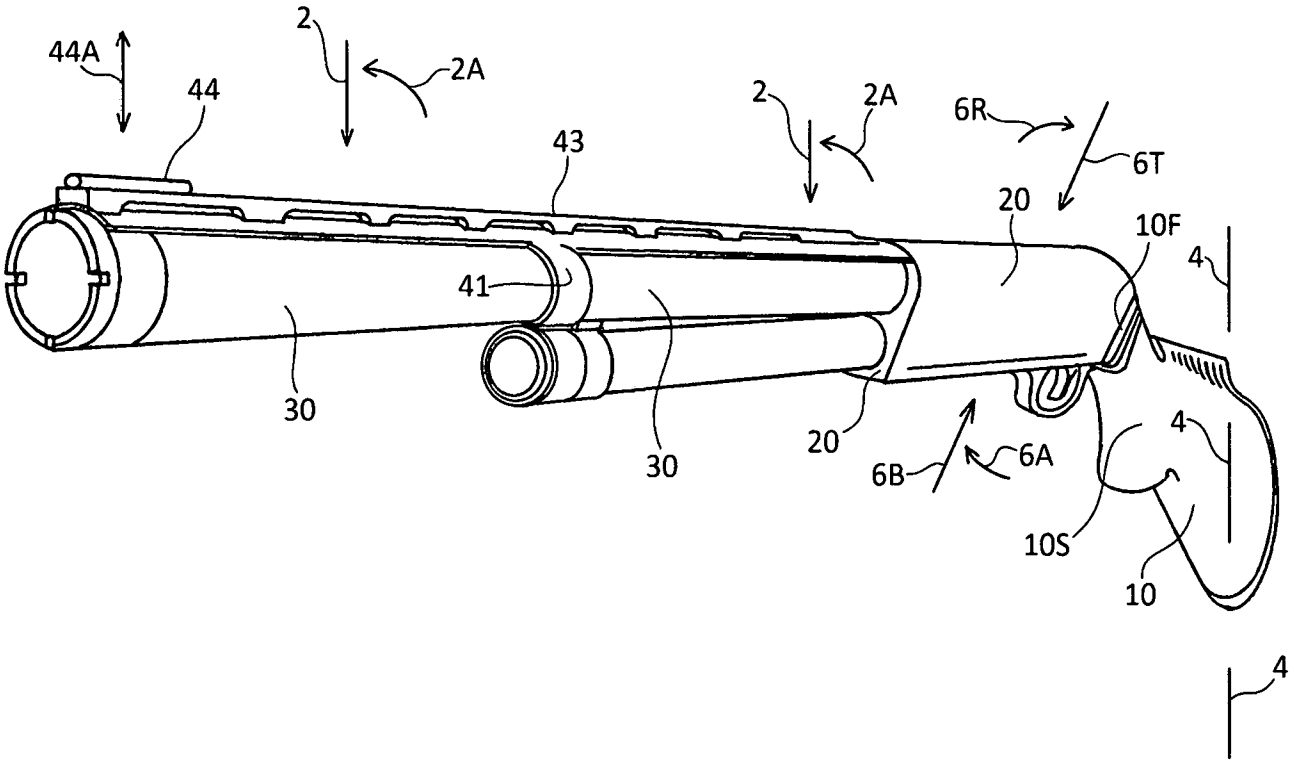
FIG. 5. Front quartering side view of a shoulder-fired fire arm showing the offset of the firing mechanism and the top centering of the sighting device.

FIG. 5. The second member (10S) of the rotating stock butt (10) is in a vertical position indicated by lines (4).

The top portion of the firing mechanism (20) has been rotated to the right, indicated by arrow (6R), the bottom portion of the firing mechanism (20) has been rotated to the left indicated by arrows (6A). The degree of rotation selected is indicated by arrows (6T) and (6B). The point of rotation occurs between the first member (10F) and the second member (10S) of the rotating stock butt (10).

The ventilated sight rib (43) has been rotated to the right, indicated by arrows (2A), placing the ventilated sight rib (43) and the sight bead (44) at the top and center of the barrel (30), indicated by arrows (2) and double-headed arrow (44A).

A support band (41) or a tightening band (70) circumferences the center of the barrel (30).

Figure 6:
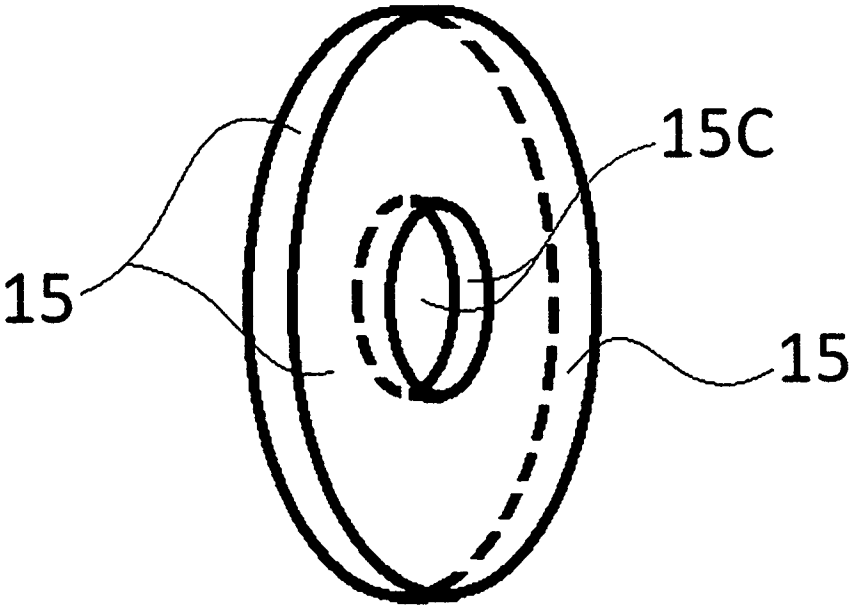
FIG. 6. Side quartering view of a spacer.

FIG. 6. Removable spacers (15) having a central opening (15C) which houses either an action spring tube (20B) or an elongated fastener (18).

Figure 7:
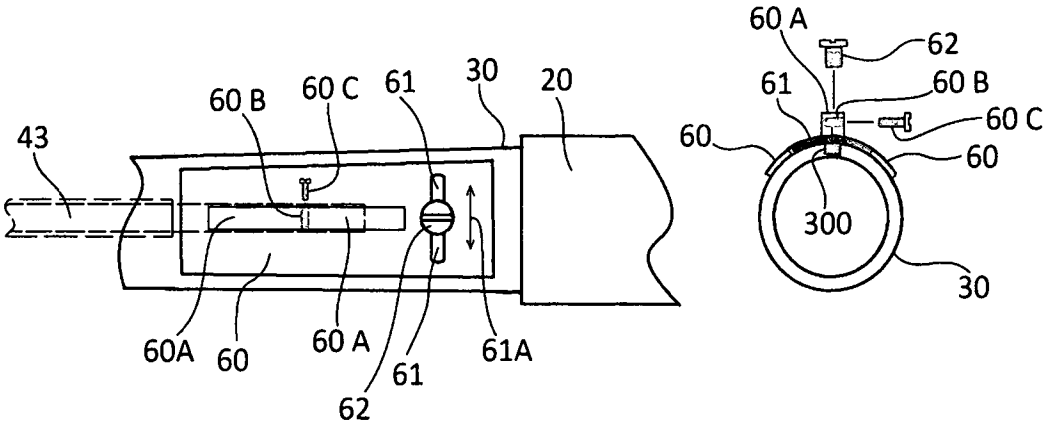
FIG. 7. A top and end view of the rear mounting base member.

FIG. 7. The rear mounting base member (60) partially circumferences the barrel (30).

The rear mounting base member (60) has an elongated opening (61) that fastener (62) passes through and fastens into threaded opening (300). When fastener (62) is loosened, the rear mounting base member (60) can be partially rotated to either the left or the right, indicated by double-headed arrow (61A). When fastener (62) is tightened, it secures the rear mounting base member (60) in a selected position.

Second multiple sight apparatus mount (60A) is linked to the rear mounting base member (60).

A threaded opening (60B) passes through the second multiple sight apparatus mount (60A).

A threaded fastener (60C) passes through an opening in the ventilated sight rib (43) and threads into the threaded opening (60B) which secures the ventilated sight rib (43) (shown in broken lines) to the second multiple sight apparatus mount (60A).

An opening (60B) in the second multiple sight apparatus mount (60A) provide means for different sighting beads (not shown) to be attached to the rear mounting base member (60).

Figure 8:
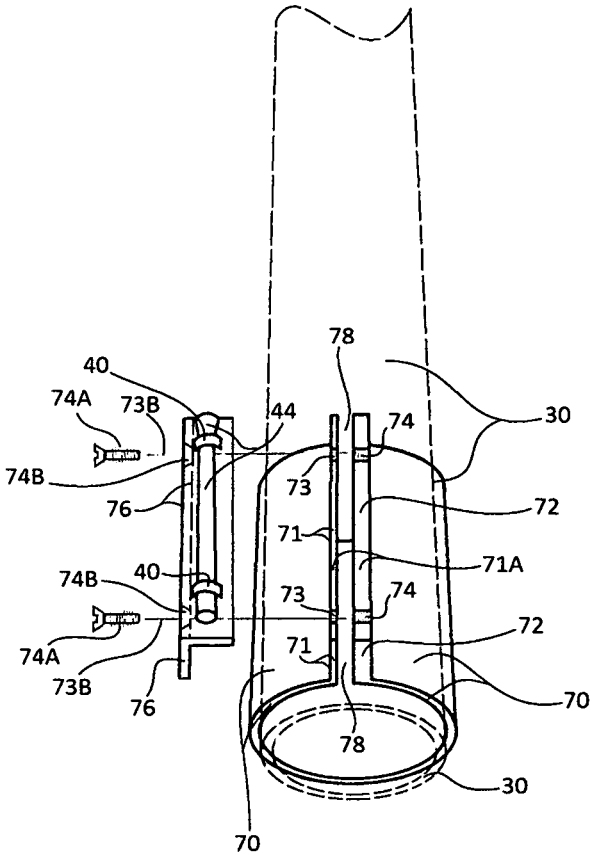
FIG. 8. A front quartering view of the tightening band and all of its components.

FIG. 8. Tightening band (70) houses the barrel (30).

A first member (71) and a second member (72) make up a third multiple sight apparatus mount (71A).

The first member (71) has openings (73); the second member (72) has threaded openings (74).

A sight bead apparatus (76) has openings (74B).

Openings (74B) in sight bead apparatus (76) and openings (73) in the first member (71) of the third multiple sight apparatus mount (71A) align with each other, indicated by line (73B), and allow fasteners (74A) to pass through openings and thread into the threaded openings (74) in the second member (72) of the third multiple sight apparatus mount (71A) indicated by line (73B).

Fasteners (74A), tighten into threaded openings (74) and fasten the sight bead apparatus (76) to the third multiple sight apparatus mount (71A). The gap (78) between the first member (71) and the second member (72) close together when fasteners (74A) are tightened into threaded openings (74) in the second member (72) of the third multiple sight apparatus mount (71A), tightening the tightening band (70) around the barrel (30).

Sight bead (44) is attached to the sight bead apparatus (76) by bands (40).

Bands (40) link to the sight bead apparatus (76).

Figure 9:
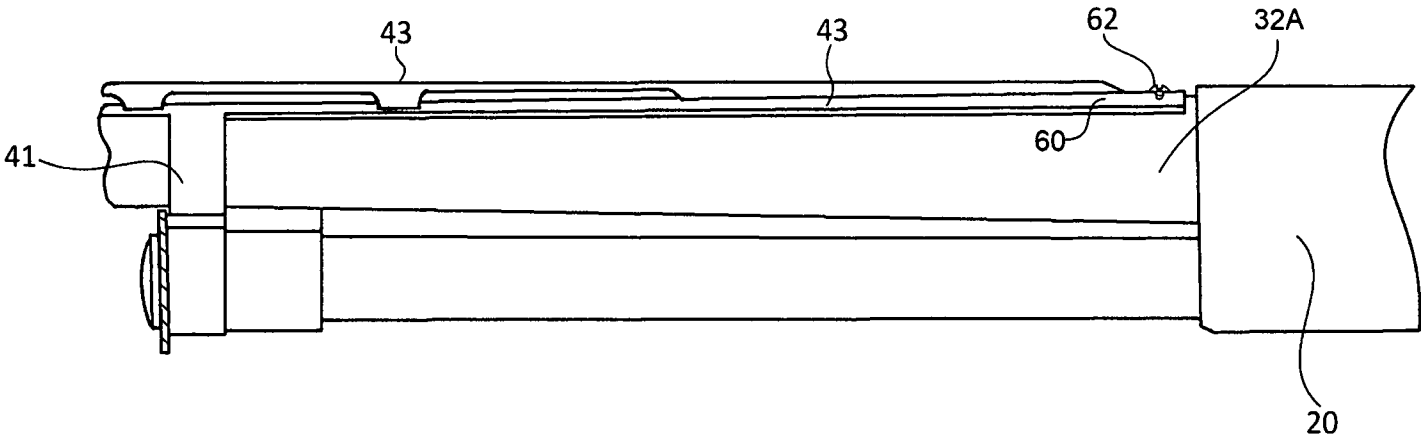
FIG. 9. Side view of the rear portion of the ventilated rib and the attaching members.

FIG. 9. Ventilated rib (43) extends to the rearward trailing end of the barrel (32A) that links to rear mounting base member (60) and is held in place by fastener (62).

A support band (41) or a tightening band (70) and its components, secure the central portion of the ventilated rib (43) to the central portion of the barrel (30) when the ventilated rib (43) extends from the forward leading end to the rearward trailing end of the barrel (30).

Figure 10:
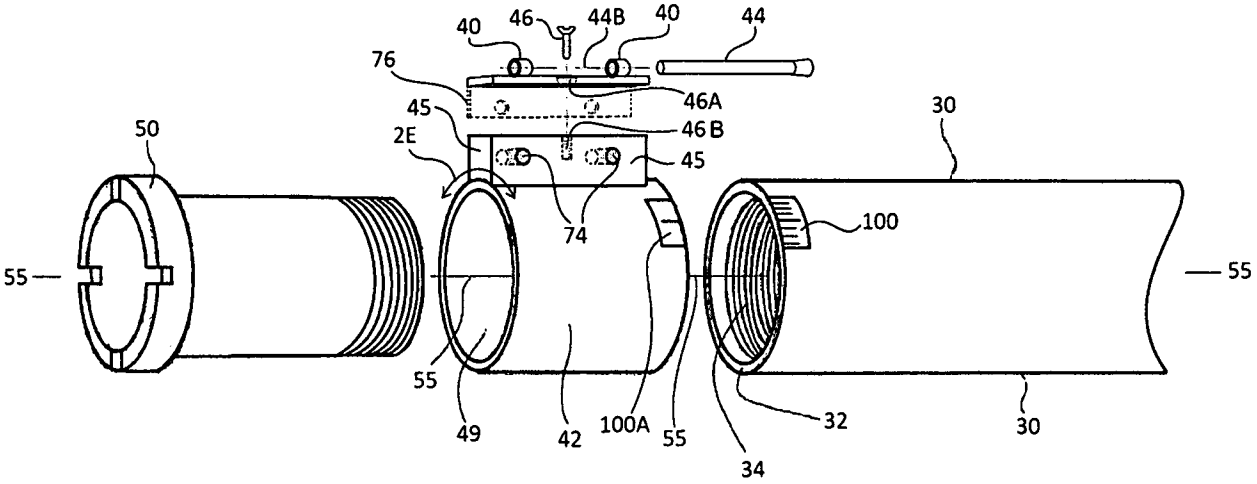
FIG. 10. Front quartering view of the rotating tube and its components.

FIG. 10. Rotating tube (42) links to first multiple sight apparatus mount (45).

Threaded openings (74) pass through the first multiple sight apparatus mount (45).

Rotation degree markers (100 and 100A) may be rotated to the left or to the right, indicated by double-headed arrow (2E).

Fastener (46) travels through the opening (46A) in the sight bead apparatus (76) and threads into opening (46B) in the first multiple sight apparatus mount (45).

The line of travel (44B) of the sight bead (44) when inserted into the bands (40).

Figure 11:
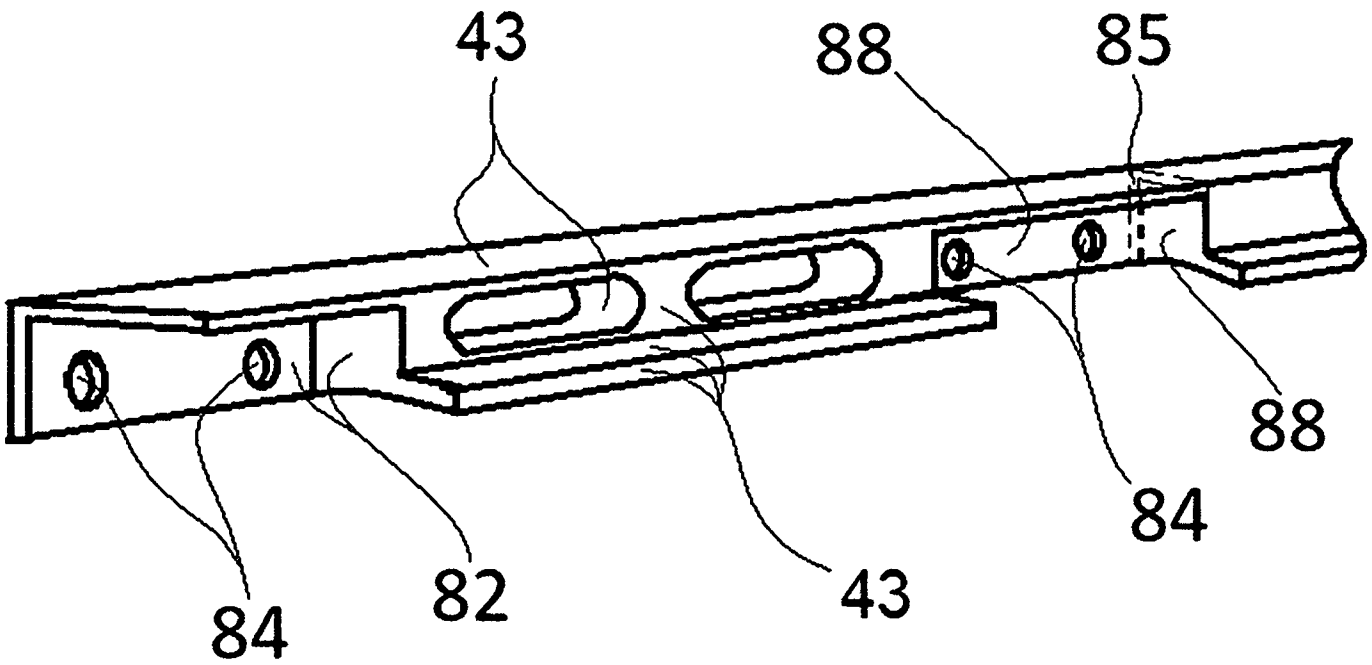
FIG. 11. Side front quartering view a section of a ventilated rib

FIG. 11. The cavities (82) and (88) of the ventilated rib (43) are configured to house the first multiple sight apparatus mount (45) of the rotating tube (42) or the second multiple sight apparatus mount (60A) of the rear mounting base member (60) or the third multiple sight apparatus mount (71A) of the tightening band (70).

Fasteners of the tightening band (70), the rotating tube (42) and the rear mounting base member (60) pass through the openings (84) in the ventilated rib (43).

Broken lines (85) indicate the end of the ventilated rib (43) if the cavity (88) is mounted to the second multiple sight apparatus mount (60A) at the rear mounting base member (60).

Figure 12:
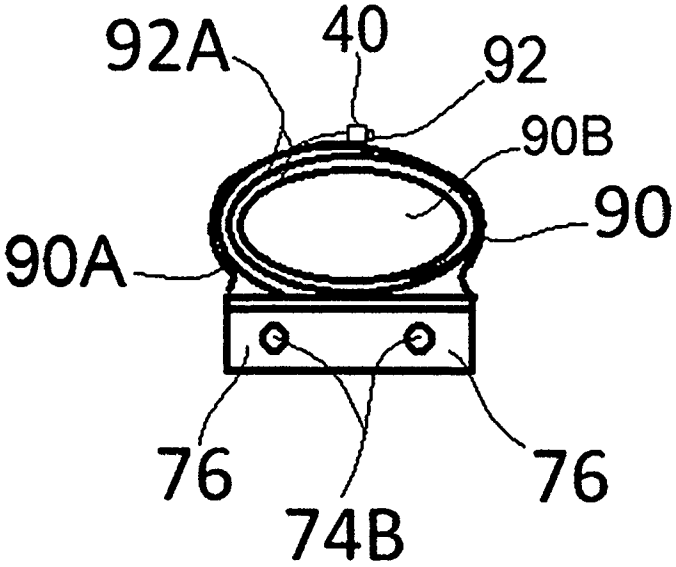
FIG. 12. Side view of a sight bead apparatus

FIG. 12. The sight bead apparatus (76) having a forward support member (90A) and a rearward support member (90).

The forward support member (90A) and the rearward support member (90) join at the top and link to a band (40) that secures the sight bead (92), such as a fiber optic coil (92A), at top center.

Fiber optic coil is coiled in an opening between the forward support member (90B) and the rearward support member (90).

The invention claimed is:

1. A shoulder-fired firearm comprising:

a firing mechanism;

a barrel;

at least one rotating sighting device;

a rotating stock butt;

a grip;

a central cheek weld;

wherein a top longitudinal surface of the rotating stock butt is lower than a top longitudinal surface of the firing mechanism, barrel and rotating sighting device when the shoulder-fired firearm is in a horizontal firing position, all description hereafter is written to this orientation;

wherein the rotating stock butt comprises a first member and a second member, the first and second members provide an axis for rotation, the axis substantially parallel with the barrel, the first member having a first leading end and a second rearward end;

wherein the first leading end of the first member is capable of receiving a rearward trailing end of the firing mechanism; and wherein the second rearward end of the first member of the rotating stock butt extends rearward and downward from the firing mechanism, aligning substantially parallel with the firing mechanism and the barrel;

wherein a central opening extends from the first leading end to the second rearward end of the first member of the rotating stock butt, and wherein a central opening extends from a first leading end to a second rearward end of the second member of the rotating stock butt;

wherein the central opening in the first member of the rotating stock butt is configured to house an elongated threaded fastener or an action spring tube;

wherein the central opening in the second member of the rotating stock butt is configured to house an elongated threaded fastener or an action spring tube;

wherein the first leading end of the second member of the rotating stock butt is configured to align with the second rearward end of the first member of the rotating stock butt and is capable of rotating against the stationary first member of the rotating stock butt;

wherein the second member of the rotating stock butt comprises a recoil pad that fastens to the second rearward end of the rotating stock butt;

wherein a length of the rotating stock butt is configured to be changed by a series of removable spacers.

2. The shoulder-fired firearm of claim 1 further comprising:

an elongated fastener;

wherein the elongated fastener having a first leading end and a second trailing end;

the first leading end of the elongated fastener is threaded and fastens into a threaded opening in the rearward trailing end of the firing mechanism, and the second trailing end of the elongated fastener is configured to tighten against the second rearward end of the second member of the rotating stock butt;

wherein when the elongated fastener is loosened, the second member of the rotating stock butt can be rotated to a selected position; and wherein when the elongated fastener is tightened, it secures the first and second member of the rotating stock butt to the firing mechanism in the selected position.

3. The shoulder-fired firearm of claim 1, wherein:

the central opening that passes from the first leading end to the second rearward end of the second member of the rotating stock butt increases in diameter at the second rearward end of the second member of the rotating stock butt, and is configured to house the removable spacers when not in use; and when the removable spacers are in use to lengthen the stock butt, the removable spacers are housed between the first and second members of the rotating stock butt, and are held in place by the elongated fastener or the action spring tube that passes through their central openings;

the length of the rotating stock butt is configured to be determined by the number of removable spacers used between the first and second members of the rotating stock butt; wherein whether in use to lengthen the rotating stock butt, or in storage, the removable spacers are configured to ensure the threaded fastener threads to essentially the same depth within the firing mechanism.

4. The shoulder-fired firearm of claim 1 further comprising:

a rotating tube;

the rotating tube configured to rotate and to be secured in position;

the rotating tube configured to allow a choke tube to pass through an opening in the rotating tube and secure the rotating tube in a selected rotational position.

5. The shoulder-fired firearm of claim 4 further comprising:

a front rotating sighting mount;

the front rotating sighting mount having a lower surface that links to the rotating tube, and having an upper surface that is configured to receive a sight bead.

6. The shoulder-fired firearm of claim 4 further comprising:

a locking ring;

the locking ring configured to be located between a forward leading end of the barrel and a rearward trailing end of the rotating tube;

the locking ring configured to circumference a center elongated portion of the choke tube;

the locking ring configured to prevent rotation of the rotating tube when the choke tube is tightened against the rotating tube.

7. The shoulder-fired firearm of claim 4 further comprising:

a rear rotating sight mount configured to partially circumferences the barrel, having a first opposing side and a second opposing side;

an elongated opening extending from the first opposing side to the second opposing side of the rear rotating sight mount;

the elongated opening of the rear rotating sight mount configured to allow a fastener to pass through and fasten into an opening within the firearm barrel;

the rear rotating sight mount configured such that when the fastener that passes through the elongated opening is loosened, the rear mounting base member is configured to rotate from side to side; and when the fastener that passes through the elongated opening is tightened, it is configured to secure the rear rotating sight mount into a selected stationary position rear rotating sight mount having a series of openings that are configured to receive sighting devices.

8. The shoulder-fired firearm of claim 7, further comprising:

a ventilated rib configured to partially circumferences the firearm barrel;

the forward leading end of the ventilated rib configured to be linked to the rotating tube;

the rearward trailing end of the ventilated rib configured to be linked to the rear rotating sight mount;

the ventilated rib extending from the forward leading end to the rearward trailing end, or any length of, the firearm barrel;

the ventilated rib having a central portion which circumferences the barrel, and a sight bead, which attaches to the forward leading end of the ventilated rib.

9. The shoulder-fired firearm of claim 1 further comprising:

the top cheek weld portion of the stock butt narrowed into a fin;

the fin is at the upper portion of the cheek weld and extends from the grip to the rearward trailing end of the rotating stock butt.

10. A method of using the shoulder-fired firearm of claim 1 comprising the steps of:

positioning the rotating stock butt, including the grip, the cheek weld, and the recoil pad, below the top longitudinal surface of the firing mechanism, the barrel, and the rotating sighting device, including a sight bead, when the shoulder-fired firearm is in the horizontal firing position;

wherein the orientation of adjustments between the rotating stock butt and the rotating sighting device starts with the second member of the rotating stock butt in a substantially vertical alignment;

the top of the firing mechanism and the barrel of the firearm are rotated a selected number of degrees;

at least one rotating sighting device rotates around the barrel substantially the same number of degrees in an opposite direction, placing the sight bead of the rotating sighting device substantially vertically centered above the barrel of the shoulder-fired firearm;

the second member of the rotating stock butt remains in substantially vertical alignment;

the rotation within the rotating stock butt allows the firing mechanism and the barrel of the shoulder-fired firearm to rotate in front of a user's eye, minimizing rotation of the user's head, while the firearm is held in the selected, fixed firing position; and the cooperation between the rotating stock butt and the rotating sighting device is configured to give equal advantage to both a right-handed and a left-handed user.

* * * * *